US009988722B2

(12) United States Patent
Neogi et al.

(10) Patent No.: US 9,988,722 B2
(45) Date of Patent: Jun. 5, 2018

(54) METHOD FOR IMPARTING TARNISH PROTECTION OR TARNISH PROTECTION WITH COLOR APPEARANCE TO SILVER, SILVER ALLOYS, SILVER FILMS, SILVER PRODUCTS AND OTHER NON-PRECIOUS METALS

(71) Applicant: Serenity Technologies, Inc., Temecula, CA (US)

(72) Inventors: Suneeta S. Neogi, Temecula, CA (US); Jayant Neogi, Temecula, CA (US)

(73) Assignee: Serenity Technologies, Inc., Temecula, CA (US)

( * ) Notice: Subject to any disclaimer, the term of this patent is extended or adjusted under 35 U.S.C. 154(b) by 241 days.

(21) Appl. No.: 14/457,819

(22) Filed: Aug. 12, 2014

(65) Prior Publication Data

US 2015/0030872 A1 Jan. 29, 2015

Related U.S. Application Data

(62) Division of application No. 13/041,988, filed on Mar. 7, 2011, now Pat. No. 8,802,202.

(Continued)

(51) Int. Cl.

| | |
|---|---|
| ***B22F 7/04*** | (2006.01) |
| ***C23C 28/00*** | (2006.01) |
| ***C23C 24/08*** | (2006.01) |

(52) U.S. Cl.

CPC ..... *C23C 28/00* (2013.01); *C23C 24/082* (2013.01); *Y10T 428/12049* (2015.01); *Y10T 428/12063* (2015.01); *Y10T 428/30* (2015.01); *Y10T 428/31504* (2015.04); *Y10T 428/31678* (2015.04); *Y10T 428/31982* (2015.04)

(58) Field of Classification Search

None

See application file for complete search history.

(56) References Cited

U.S. PATENT DOCUMENTS 4,360,820 A * 11/1982 Forster ..... G11B 7/2542 283/61

5,076,663 A 12/1991 Arendt et al.

(Continued)

OTHER PUBLICATIONS

Wang et al., "Hydrolysis of TiCl4: Initial Steps in the Production of TiO2", 2010, J. Phys. Chem. A., vol. 114, pp. 7561-7570.*

(Continued)

*Primary Examiner* — Seth Dumbris

(74) *Attorney, Agent, or Firm* — Patterson Thuente Pedersen, P.A.

(57) ABSTRACT

A method of surface coating a metallic object, including removing substantially all of the existing silver sulfide tarnish if present, ultrasonically cleaning the object with immersion in a solvent, uniformly dispersing selected nanoparticles over the surface of the object by sonicating the object in an ultrasonic bath containing the selected nanoparticles. The invention further includes quickly rinsing the object with solvent upon removal from the ultrasonic bath to inhibit formation of large agglomerates, drying the object with a flow of gas, optically inspecting the object for the presence of agglomeration and applying a barrier layer conformal coating and a protective layer conformal coating.

11 Claims, 7 Drawing Sheets

Related U.S. Application Data

(60) Provisional application No. 61/436,466, filed on Jan. 26, 2011, provisional application No. 61/310,797, filed on Mar. 5, 2010.

(56) References Cited

U.S. PATENT DOCUMENTS

| | | | | |
|---|---|---|---|---|
| 5,914,162 | A | 6/1999 | Bilkadi | |
| 6,291,070 | B1 * | 9/2001 | Arpac | B05D 7/26 428/412 |
| 6,855,396 | B1 * | 2/2005 | Mennig | B05D 7/546 427/314 |
| 9,108,888 | B2 * | 8/2015 | Neogi | C04B 41/009 |
| 2002/0106476 | A1 * | 8/2002 | Hirai | B01J 13/0008 428/64.4 |
| 2002/0187350 | A1 | 12/2002 | Saccomanno et al. | |
| 2004/0131867 | A1 * | 7/2004 | Bier | B05D 7/546 428/447 |
| 2004/0247899 | A1 * | 12/2004 | Bier | C08J 7/045 428/447 |
| 2006/0266442 | A1 * | 11/2006 | Narayan | B82Y 30/00 148/437 |
| 2007/0039665 | A1 | 2/2007 | Johns et al. | |
| 2007/0115474 | A1 * | 5/2007 | Chaton | B82Y 5/00 356/445 |
| 2008/0072705 | A1 * | 3/2008 | Chaumonnot | C01B 39/48 75/338 |
| 2008/0102307 | A1 * | 5/2008 | Zidar | B32B 15/01 428/640 |
| 2008/0118651 | A1 | 5/2008 | Brand et al. | |
| 2008/0318012 | A1 * | 12/2008 | Domnick | C09C 1/0015 428/216 |
| 2009/0122310 | A1 * | 5/2009 | Zhang | B82Y 15/00 356/301 |
| 2009/0257062 | A1 * | 10/2009 | Rubinstein | B82Y 15/00 356/445 |
| 2010/0068503 | A1 | 3/2010 | Neogi et al. | |
| 2010/0309539 | A1 * | 12/2010 | Kaye | G02F 1/0147 359/288 |

OTHER PUBLICATIONS

Kim et al., "A Route to Nanoscopic SiO2 Posts via Block Copolymer Templates", 2001, Adv. Mater, vol. 13, pp. 795-797.*
L. Gal-Or, 4th Santa Fe Symposium on Jewelry Manufacturing Technology (1990), p. 19.
H. Royal, 4th Santa Fe Symposium on Jewelry Manufacturing Technology (1990). p. 37.
Enick, U.S. Pat. No. 6,183,815 (Feb. 2001).
Burleigh, Corrosion, V. 56 (2002), p. 49.
Salmon, 12th Santa Fe Symposium on Jewelry Manufacturing Technology (1998), p. 363.
Ullman's Encyclopedia of Industrial Chemistry, V. A24 (1993), p. 148.
[1]: CAL-IN Technology Transfer, LLC.
Protective coating of Silver, Makela, Milja et al., US Patent Appl. 20090004386.
Brinker et al., Sol-Gel Science. The Physics and Chemistry of Sol-Gel Processing, Academic Press, New York, 1990.
Pierre, Introduction to Sol-Gel Processing, Kluwer, Boston, 1998.
Michael T. Roche, BHP Biliton, Townsville, Queensland, Austrialia, Frank E. Goodwin, International Lead Zinc Research Organization Inc., Research Triangle Park, NC, USA, "Improved Tarnish Resistant Sterling Silver", 8 pages.
Prof. Byeong-Soo Bae, Dept. of Materials Sci. & Eng., KAIST, MS512 Nano Technology, Sol-Gel Nano Materials and Process, 70 pages.
D'Agostino et al., "Protection of Silver-Based Alloys from Tarnishing by Means of Plasma-Enhanced Chemical Vapor Deposition," Plasma Processes and Polymers, vol. 1, 2005, pp. 91-96.
Frey et al, "Tarnish protection of silver jewels by plasmapolymer coatings," Surface and Coatings Technoogy, vols. 173-174, 2003, pp. 902-904.
International Search Report for PCT Application No. PCT/US2011/027396, dated Mar. 7, 2011, 3 pages.
Written Opinion of International PCT Application No. PCT/US2011/027396, dated Nov. 15, 2011, 4 pages.
Application and File History for U.S. Appl. No. 13/041,988, filed Mar. 7, 2011. Inventors: Neogi et al.

* cited by examiner

METHOD FOR IMPARTING TARNISH PROTECTION OR TARNISH PROTECTION WITH COLOR APPEARANCE TO SILVER, SILVER ALLOYS, SILVER FILMS, SILVER PRODUCTS AND OTHER NON-PRECIOUS METALS

RELATED APPLICATION

This application is a division of application Ser. No. 13/041,988 filed Mar. 7, 2011, which claims the benefit of U.S. Provisional Application No. 61/310,797, filed Mar. 5, 2010 entitled "Method for Imparting Tarnish Protection to Silver, Silver Alloys, Silver Films and Silver Products" and U.S. Provisional Application 61/436,466 filed Jan. 26, 2011 entitled "Method for Imparting Tarnish Protection or Tarnish Protection with Color Appearance to Silver, Silver Alloys, Silver Films, Silver Products and other Non-Precious Metals," each of which is hereby fully incorporated herein by reference.

FIELD OF THE INVENTION

The present invention relates to methods for imparting tarnish resistance to silver, its alloys and all silver products and methods for imparting the appearance of carat gold, colored gold, or rhodium with built-in anti-tarnish properties to silver, its alloys and all silver products. The invention also relates to imparting such an appearance to non-silver metals that are used in a functional or decorative application without the use of gold or other precious metals.

BACKGROUND OF THE INVENTION

Silver has long been valued as a precious metal, and it is used to make ornaments, jewelry, high-value tableware, utensils (hence the term silverware), and currency coins. One of the drawbacks of silver is its tendency to tarnish naturally in atmosphere due to the formation of silver sulfide. The appearance of the silver rapidly deteriorates based upon the thickness of the silver sulfide coating from initial yellowing of the surface finally resulting in a black film. The most common tarnish causing elements are food (onions, eggs, mayonnaise, salad dressing, salty foods) salt, wool, felt, rubber bands, latex gloves, carpet padding, sulfur in the air and oily residue from human hands and fingers.

Tarnish is generally caused by a reaction of sulfur, either from the surrounding air or perspiration that reacts with silver to form $Ag_2S$. Several species other than silver sulfide can also be found on tarnished surfaces. These include sulfate, chloride, oxide, organic carbon, and oxygenated organic carbon species and a carbonate or carbonyl. In some cases these species can be present at comparable or very much higher concentrations than silver sulfide. Particulate deposition can result in species such as sodium, potassium and silicon being present in the tarnished layer. The relative concentrations of each of these species will obviously vary, depending upon the environment to which the silver surface is exposed. Even if handled carefully, and exposed in closed cases, there is sufficient sulfur and other of the above species in most air to result in tarnishing of sterling silver after a few days, which appears as a black scale. To combat this problem, jewelry stores and others use cloth or similar strips treated to function as a sulfur "getter" in display cases, lengthening the time before which noticeable tarnishing appears. The sulfur "getter" includes a substance with a higher chemical reactivity than silver to remove sulfur based chemicals from the air. Such a treatment, however, is not possible for sterling silver kept in environments that are not well sealed. Replacement of the sulfur absorption strips is also required after some time.

Tarnish of silver can be removed by either polishing removal of the tarnish film or by reversing the chemical reaction that caused formation of silver sulfide. Whatever the method employed, tarnish removal is a laborious process that may damage the appearance of the silver article.

There are various methods practiced currently that minimize or attempt to prevent the formation of tarnish. Of the many approaches that have been taken to solving this problem in the past, most of these rely upon alloying of silver to make more tarnish resistant compositions.

At least five different approaches to alloying of silver to reduce the onset of tarnishing have been made:

U.S. Pat. No. 4,775,511, issued October 1988, describes the use of additions to silver-copper, silver-gold and silver-copper-gold alloys of at least one element of the following: Cr, Ta, Al, Ti, or Th, where the added amounts of these elements does not exceed 1.5 wt. % as a substitute for silver. These elements were found to form a thin oxide layer, which was stable and did not affect the properties of the silver based alloy. The elements were found to be self-healing, forming a layer of oxide and also reacting preferentially with sulfur to form sulfides, rather than formation of silver sulfide. In this way, tarnish resistance was improved. All of these elements were recognized as having heats of sulfide formation, which were higher than that of silver. The preferential additions to silver-copper alloys were Al and Cr at about 0.5 wt. % and for silver-gold and silver-copper-gold alloy Cr at 0.4 wt. %. An improvement of 10-12 times increase in sulfide tarnish inhibition for sterling silver was claimed. This increase could also be reached by adding 0.75% Ti, 1.25% Th or 1.5% Ta.

U.S. Pat. No. 5,817,195 describes a tarnish resistant alloy containing 6.57% Zn, 0.25% Cu, 0.25% Ni, 0.25% In, and 0.18% metal silicates. These silicates involve other alloying elements than those listed, because those listed are not silicate formers. However, it is claimed that these silicates improve castability by making the molten metal more fluid. This alloy is claimed to have a more stable color than sterling silver. The addition of nickel eliminates the brittleness of traditional sterling silver after casting. Zinc replaces copper to enhance tarnish resistance and improve overall corrosion resistance. Nickel must be added to the alloy in equal amounts with copper to cause all the constituents to remain in solution.

U.S. Pat. No. 5,039,479 describes the usefulness of the additions of silicon, boron and tin to an alloy similar to that described in U.S. Pat. No. 5,817,195. The preferred composition is 1.85% Zn, 0.05% In, 4% Sn, 1.44% Cu, 0.01% B, and 0.05% Si. Si is added as a deoxidizer and is claimed to reduce the porosity of recast alloys. B is added to reduce the surface tension of the molten alloy. Zn is added to reduce the melting point of the alloy, and whiteness to act as a copper substitute, to help in deoxidization and to improve alloy fluidity during casting. Sn is added to improve tarnishing resistance and for its hardening effect. In is added as a grain refining agent and improves the wettability of the alloy. The composition described is sufficiently pure in silver to qualify as sterling silver. A similar approach is taken by U.S. Pat. No. 5,882,441 which describes a tarnish resistant 4.5% Zn-2.9% Cu-0.1% S alloy.

Addition of more noble elements increases the cost of sterling silver, but is highly effective. U.S. Pat. No. 5,037,708 describes an alloy containing 5% Pd, 2% Cu and 0.5%

In or Zn. In this alloy the Cu has been replaced by Pd to enhance tarnish resistance and corrosion resistance and also to improve color stability. The working and casting properties are also improved, and Cu and In also help reduce brittleness.

The hardness and tarnish resistance of fine silver, with at least 99.5% purity, is claimed to be improved by the disclosure of U.S. Pat. No. 6,139,652, issued Oct. 31, 2000. Small additions of Al, Sb, Ca, Ga, Ge, In, Li, Mn, Mg, Si, Sn, Ti, or Zn are added. The cast alloy is then annealed in an oxygen-rich atmosphere to give internal oxidation, hardening the alloy. This allows it to be age hardened to at least 136% of its annealed hardness, improved tarnish resistance is also claimed, likely by formation of surface oxides rich in the alloying elements.

Several of these alloys have been commercialized. For example, Ney Paliney 6 is a platinum silver-based alloy used for throttle position sensors, guidance systems, potentiometers, trimmers, communications and bar code readers. Sterling "D" is a white colored sterling silver offered by United Precious Metal Refining. It claims to have excellent tarnish resistance.

The addition of Ge to sterling silver is also noted to reduce tarnishing and fire stain. This alloy is a cadmium-free alternative to the 2 and 4% cadmium bearing grades that have been used in the past. This composition is disclosed by UK Patent 2,255,348B. A similar composition was claimed by Metaleurop in their German application 4,213,897 of Nov. 5, 1992. This alloy contains between 0.5 and 3% Ge, the balance of Cu to give 7.5% alloy addition and 92.5% Ag to give sterling silver. This alloy is currently marketed as Argentium Silver. The common perception is that Argentium silver is tarnish resistant but in fact this alloy also tarnishes similar to regular sterling silver, the only difference being that the color of the tarnish layer is transparent yellow instead of the black layer developed in regular silver. The cost of Argentium silver alloy is almost double the cost of regular sterling silver providing another drawback for its use by consumers.

None of above methods, consisting of alloying additions, completely eliminates tarnishing of silver and additionally is not cost effective as compared to the most common form of silver which is the sterling silver.

Metallic coatings by electroplating, such as thin (150 Å) transparent coatings of Ni, Rh, Pt, Ir and Pd have also been used [3]. In addition electroplated silver alloy coatings containing Cd, Sb, Sr and Pd are possible. The application of these coatings is complicated and expensive, and additionally involves the use of corrosive chemicals. When these platings are too thin (due to cost considerations) they easily wear off causing localized tarnishing of silver to develop.

Oxide coatings of Al, Be, Zr, Mg, Ti, and Nb can be produced by sputtering or cathodic reduction of solutions containing the metal ions [1, 2]. These are expensive processes and it is complicated to produce deposits on curved articles. In addition, the abrasion resistance of these coatings is poor.

Chromate conversion coatings are cheap, easy to perform, and provide relatively good corrosion resistance. These coatings can be applied by either chemical immersion or electrochemical treatment. One process has been patented that uses phosphate with 1-2% chromate followed by drying at 150° C. [2]. Electrochemical chromate coatings are more expensive to produce than those made by the immersion systems. All of the chromate processes use hexavalent chromium which is toxic and in many countries its use is either being banned or phased out.

Non-chromate conversion coatings are generally based on tin compounds that produce coatings that are not as durable as chromate coatings [2, 4-6]. There are several coatings based on organic coating materials, which provide hydrophobic films on silver that are resistant to tarnishing in accelerated tests. In some cases, such as when the coating s are based on thiols, the stable complex of silver is formed but in no case are these coatings as durable as chromate conversion coatings.

Organic coatings protect silver by forming a physical barrier between the sulfur and the silver, and are generally used for storage and display of silver items. Lacquers can be applied by brushing, dipping or spraying, and organic inhibitors can be added to improve protection. The main problem with these layers is that they are nearly always visible and if they are too thin the silver items are not sufficiently protected.

Polishes have been produced that claim to give tarnish protection and contain reducing compounds such as sodium dithionite and corrosion inhibitors such as morpholine [6]. There are no data known to the Applicant on the extent of protection afforded.

Other methods of tarnish prevention include storing silver in special storage materials such as certain polymers that react with sulfur to prevent its attack on silver [7]. This type of method helps keep the silver in a reasonable condition only so long as it is kept within the storage materials.

The use of atomic layer deposition (ALD) technique as in bibliography entry [8] provides for the most conformal technique thus eliminating any non-uniformity that can cause discoloration of silver due to optical interference. The method described in [9] and commercialized by the Beneq Oy company under the nSILVER® process is practiced in a jewelry context solely for the purpose of allowing the display of silver products in retail stores without the need for storing in special storage materials. Silver products coated with oxides using an ALD process have limitations due to change in appearance of the silver depending on the type of oxide and the coating thickness as well as loss of ability to prevent tarnishing over time due to wearing out of the protective layer or localized breakdown of the protective layer due to adhesion problems.

In India, a style of jewelry making called "Kundan" dates back several thousand years. Kundan jewelry work involves the use of diamonds or cut glass, various precious and semi-precious colored stones, pure 24K gold as well as pure silver and detailed enameling work. One method of Kundan jewelry manufacturing uses silver foil that is cut to a shape similar to the pavilion of the uncut diamonds or glass pieces. These silver foil shapes are placed in the skeletal structure of the jewelry piece which is fashioned such that there are holder or cups for receiving the stones. The uncut diamonds or cut glass pieces are placed over the foil in order to give a luminous and brilliant appearance. The stone is secured by using 24K gold foil which is beaten to conform to the periphery of the stone. Over a period of time the embedded silver foil gets tarnished causing the Kundan piece to get discolored.

Gold has been a highly sought-after precious metal, even more so than silver, for coinage, jewelry, and other objects since the beginning of recorded history. Like other precious metals gold is measured by troy weight and grams. When alloyed with other elements the term carat or karat is used to indicate the amount of gold present. The price of gold being several orders of magnitude higher than silver makes gold's use in jewelry is the key application other than its use as an investment or in other industries. The price of gold has been steadily rising over the decades making its use in jewelry more and more expensive. There has long been a great demand for gold plated products and jewelry which occupy a large segment of the low-cost decorative articles market. Gold platings are applied on silver or other metals by chemical or electrochemical means to provide the object with the appearance of carat gold. The plating thickness varies according to the value placed on the article. Gold platings wear off with time and, when plated on silver, result in slow diffusion of silver to the surface causing the gold color to fade and tarnishing to occur. The high price of gold in the current economy has made gold electroplated articles and jewelry more expensive than previously.

There are methods to create the appearance of gold by vapor deposition of titanium nitride coatings but even these require the coating to contain some percentage of gold to give to a carat gold appearance. The watch industry has used titanium nitride/gold vapor deposited coatings as a means to produce low cost gold colored watches. Additionally these physical vapor deposition (PVD) based methods also require barrier layers to be deposited beneath the titanium nitride/gold layer by electroplating such as Nickel plating or Nickel with Palladium flash platings on brass before the PVD process. The watch industry uses electroplating to first deposit a layer of nickel or nickel-palladium alloy. The nickel based base layer is overlain with a PVD coating of TiN followed by gold deposition by PVD to achieve a gold appearance. Such methods for providing a cheaper alternative than gold plating do not last long under use conditions in watches, jewelry and the like. The gold appearance wears off and/or the object becomes discolored due to environmental corrosion.

There are methods of providing gold colored coatings on metals typically used by the finishing industry (door hardware, etc.) by the use of lacquer coatings but such coatings are easily distinguished from gold due a wet, shiny look. Such coatings are typically applied in thickness ranging from a few microns to tens of microns depending on the application. They cannot be applied on complex fine geometries due to the flow characteristics of the lacquer which cause loss of suppleness. Lacquer coatings can be applied in any color or as clear coatings and have great use in the automobile and hardware industry. When used on jewelry, however, they impart the look of a cheap imitation gold color which does not match the color of carat gold. Further lacquer coatings may impart an unnatural look and feel to the product. Additionally most lacquer coatings can be easily stripped off by common solvents such as acetone.

SUMMARY OF THE INVENTION

The invention solves many of the above problems. The invention includes a method of surface coating a metallic object including removing tarnish from the object if present; cleaning with immersion in a solvent; uniformly dispersing selected nanoparticles over the surface of the object; rinsing; drying; optical inspection; applying a barrier layer conformal coating; and applying a protective layer conformal coating. The invention also includes objects having the coating layers described herein.

So far as Applicant is aware, there is no method currently practiced wherein a silver article is provided with an anti-tarnish treatment including multiple conformal coatings such that the hybrid stack of conformal coatings protects the silver from tarnishing during its lifetime of use by ensuring that the treatment coatings have good adherence to the silver.

Additionally, Applicant knows of no method currently used wherein the anti-tarnish protection treatment results in a silver article that is bio-compatible in nature and thus will not interfere with the use of the article as a serving or eating utensil.

Additionally, Applicant knows of no method currently practiced where silver jewelry receives an anti-tarnish protection treatment after the jewelry piece is completely manufactured without any kind of plating treatments using rhodium or platinum.

Additionally, Applicant knows of no method currently practiced wherein the silver foil used in the making of Kundan jewelry receives an anti-tarnish protection treatment that completely prevents the tarnish and discoloration of Kundan jewelry during its lifetime of use.

Additionally, Applicant knows of no method currently practiced wherein the uncut diamonds or cut glass pieces which are employed in Kundan jewelry are themselves provided with a layer of anti-tarnishing silver on the pavilion side of the stone in a direct application without the need to use a discrete silver foil.

Additionally, Applicant knows of no method currently practiced wherein silver can be provided with the appearance of fine carat gold without the use of gold, and with anti-tarnish properties.

Additionally, Applicant knows of no method current practiced wherein plated objects such as rhodium plated or silver plated objects can be converted to have the appearance of fine carat gold without the use of gold.

Additionally, Applicant knows of no method currently practiced wherein cheap metals such as brass may be directly converted to the appearance of fine carat gold without the use of any gold platings or vapor deposited nitride coatings applied over barrier metals such as nickel plating that have to be first applied on the brass.

Additionally, Applicant knows of no method currently practiced wherein gold articles are converted to the appearance of antique gold without the use of shoe polish or other wax-based compounds that are normally used in the industry to achieve the look of antique gold.

Additionally, Applicant knows of no method currently practiced wherein delicate gold articles such as gold filigree jewelry or articles are provided with treatments to improve the surface hardness thus imparting better durability and surface wear resistance.

Additionally, the invention described here provides a method for transforming the appearance of silver, silver alloys or other metals such as brass, cobalt, plated metals, etc. to achieve any color appearance desirable for use in decorative applications such as pink, red, black etc. without the use of precious metals or plating processes. The transformation of the color appearance of silver or silver products includes anti-tarnish protection.

DETAILED DESCRIPTION OF THE DRAWINGS

The invention described here provides a robust process for producing a bio-compatible tarnish prevention treatment for functional and decorative articles of silver and silver alloys including but not limited to other metals such as copper, copper alloys and brass that are also prone to tarnish.

Additionally, the invention described here provides robust processes for converting the appearance of silver, silver alloys, other metals such as brass, cobalt, or plated metals having rhodium or silver platings to the appearance of fine carat gold, rose gold, purple gold etc. without the use of gold. Additionally, the invention described here provides a method for transforming the appearance of silver, silver alloys, other metals such as brass, cobalt, plated metals etc., to achieve the look of fine rhodium platings without the use of rhodium. Additionally, the invention described here can be used for providing a special appearance to metal jewelry such as the look of antique gold.

Filigree gold jewelry is typically very delicate due the requirement for using 22K or higher gold to create the filigree. Generally, filigree gold jewelry tends to have low wear resistance. Further, the invention described here can be used to provide improvement in the surface hardness of metallic objects that has application in areas such as filigree gold jewelry.

The invention also includes processes to prevent tarnish in functional as well as decorative articles of silver and silver alloys, pure silver foils used in specialty jewelry making such as "Kundan" as well as a process to directly deposit silver onto jewelry components that are used in "Kundan" jewelry making and rendering the silver film that is deposited to have anti-tarnish properties.

An Example Anti-Tarnish Process for Silver Objects

The process described below provides a step-by-step method for rendering a silver object, such as a decorative silver piece, silver/silver alloy jewelry or silverware used as utensil for serving and eating of food, with a long lasting anti-tarnish property.

Figure 1:
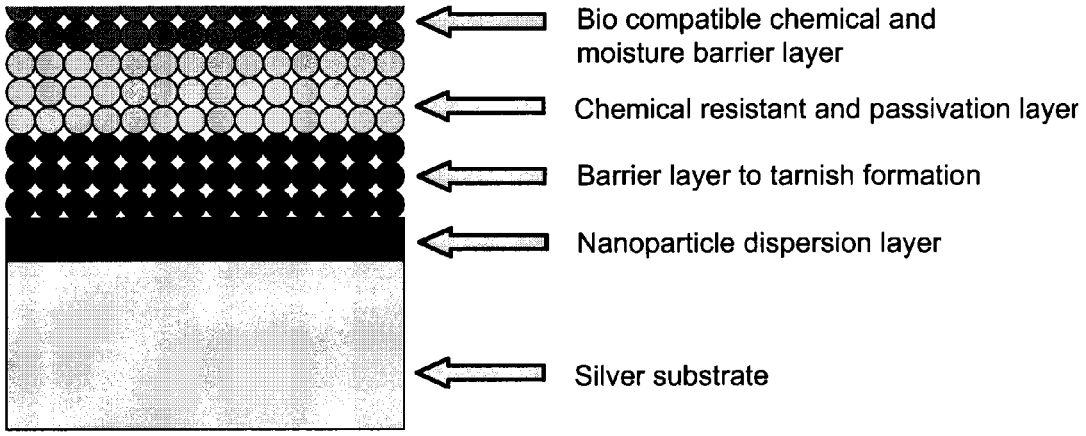
FIG. 1 is a schematic depiction of anti-tarnish treatment layers according to an example embodiment of the invention.
Figure 2:
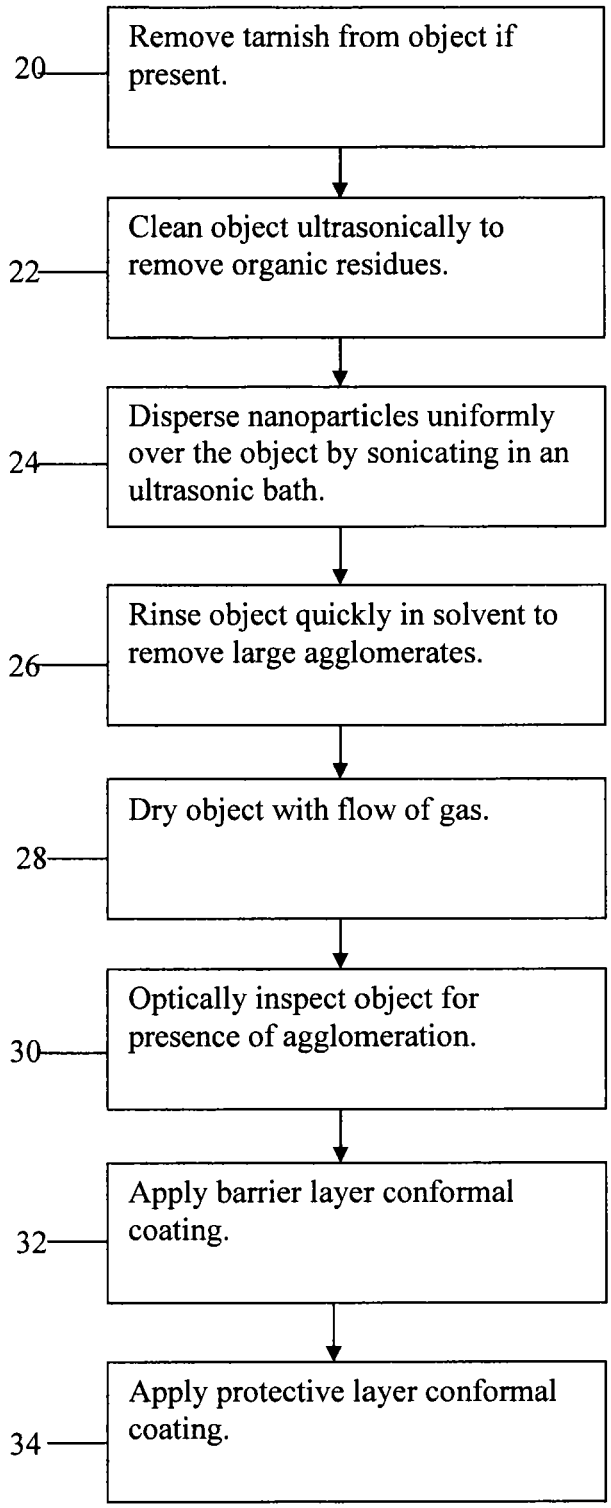
FIG. 2 is a flowchart depicting an example method of applying anti-tarnish treatment to an object according to an embodiment of the invention.

Referring to FIG. 2, in one embodiment, the method includes, at reference numeral 20: removing substantially all pre-existing tarnish from the silver article, for example, by using a commercial chemical tarnish remover such as "Silver Quick", Hagerty's Silver Dip or any other such chemical agents that reverse the silver sulfide reaction. The removal method uses a chemical reaction to convert the silver sulfide back to silver. Many metals (X) in addition to silver form compounds with sulfur. Some of them have a greater affinity for sulfur than silver does.

$$3Ag_2S+2X \rightarrow 6Ag+X_2S_3$$

At 22, the silver article is prepared by subjecting it to a thorough solvent based ultrasonic cleaning process to ensure that the surface is free of organic residues or contamination.

Figure 3:
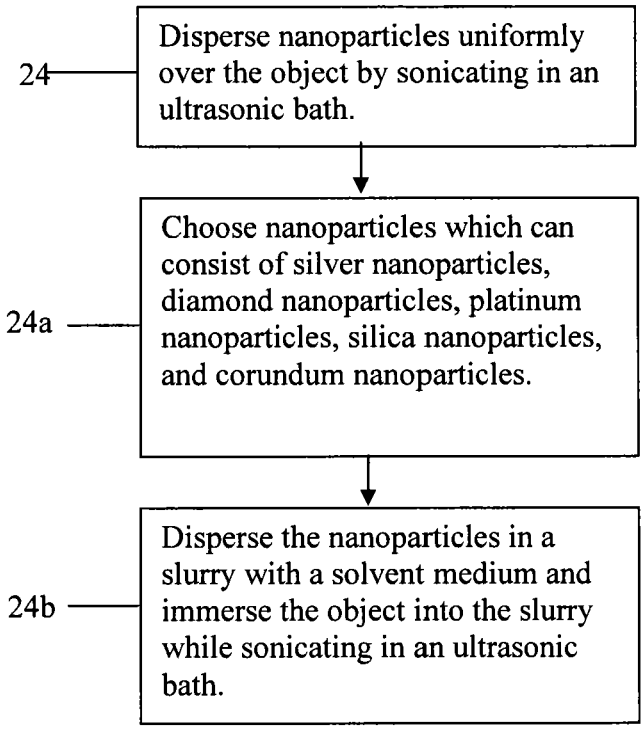
FIG. 3 is a flowchart further depicting an example method of applying treatment to an object including dispersing nanoparticles according to an embodiment of the invention of FIG. 2.

Referring to FIG. 3, at 24, the next step of the method's anti-tarnish treatment involves the use of nano-particles such as nano-silver particles, nano-diamond particles or nano-platinum particles which are dispersed uniformly over the silver article 24*a*. Silica nano-particles, corundum nano-particles and others may also be utilized. This pre-treatment step improves the adhesion and scratch resistance of the film deposited in the further steps of the process. According to an example method, nano-particles are dispersed in a solvent or water medium and a monolayer of the nano-particles are dispersed over the silver article by immersion of the silver article into the slurry containing the nano-particles under the influence of an ultrasonic bath. 24*b*.

Sonication is performed in a regular sonic bath for a duration that can be optimized by experimentation based upon the silver substrate's geometry and size. The duration of sonication is derived experimentally by performing the sonication of the silver article to be coated with a dispersion of nano-particles for various durations and examining the resulting layer for uniformity and density of coverage using an analytical technique such as scanning electron microscopy. A ultrasonic bath is a piece of industrial or laboratory equipment that consists of a container, or bath, used for cleaning, or mixing things inserted into the bath, by sending ultrasonic vibrations through the liquid in the bath. There are several commercially available ultrasonic bath systems which operate as various ultrasound frequencies (15-400 kHz).

At 26, the silver article is removed from the slurry and quickly rinsed with a solvent to prevent the formation of large agglomerates.

At 28, the silver article is dried with nitrogen and optical inspection 30 is performed to check for agglomeration that shows up as dark residues.

Figure 4:
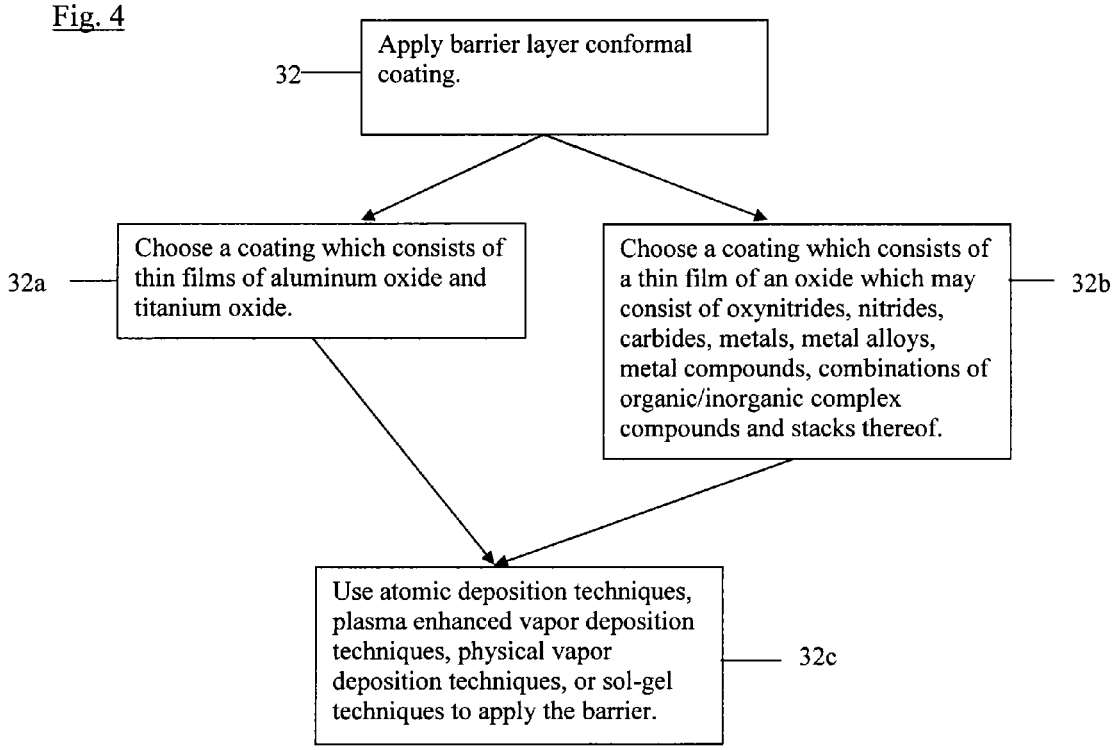
FIG. 4 is a flowchart further depicting an example method of applying treatment to an object including applying a barrier layer conformal coating according to an embodiment of the invention of FIG. 2.

The silver article with a uniform dispersion of nano-particles is ready for the next step in the anti-tarnish treatment. Referring to FIG. 4, in one embodiment of the invention, at 32, the next step involves applying a barrier layer conformal coating, for example, coating the silver object conformally with thin films of aluminum oxide and titanium oxide (32*a*). At 32*b*, various other oxides or combinations of oxide stacks may be applied. Combinations of metal, metal alloys, metal compounds (including but not limited to nitrides, oxides, oxynitrides and carbides) in stacks may be used. Combinations of organic/inorganic complex compounds may also be used. The metals, alloys and metal compounds can be chosen to include metals that show a higher affinity to sulfur than silver. At 32*c*, conformal coatings of multilayer compounds may be applied by using various vapor-based or liquid immersion techniques such as atomic layer deposition (ALD) techniques, plasma enhanced chemical vapor deposition techniques (PA-CVD), physical vapor deposition techniques (PVD), sol-gel techniques (dip, spray, spin coating methods). According to one embodiment, the thin films of multi-layer compounds are applied at a thickness between 70 nm to 500 nm to minimize a change in optical appearance of the silver article.

Figure 5:
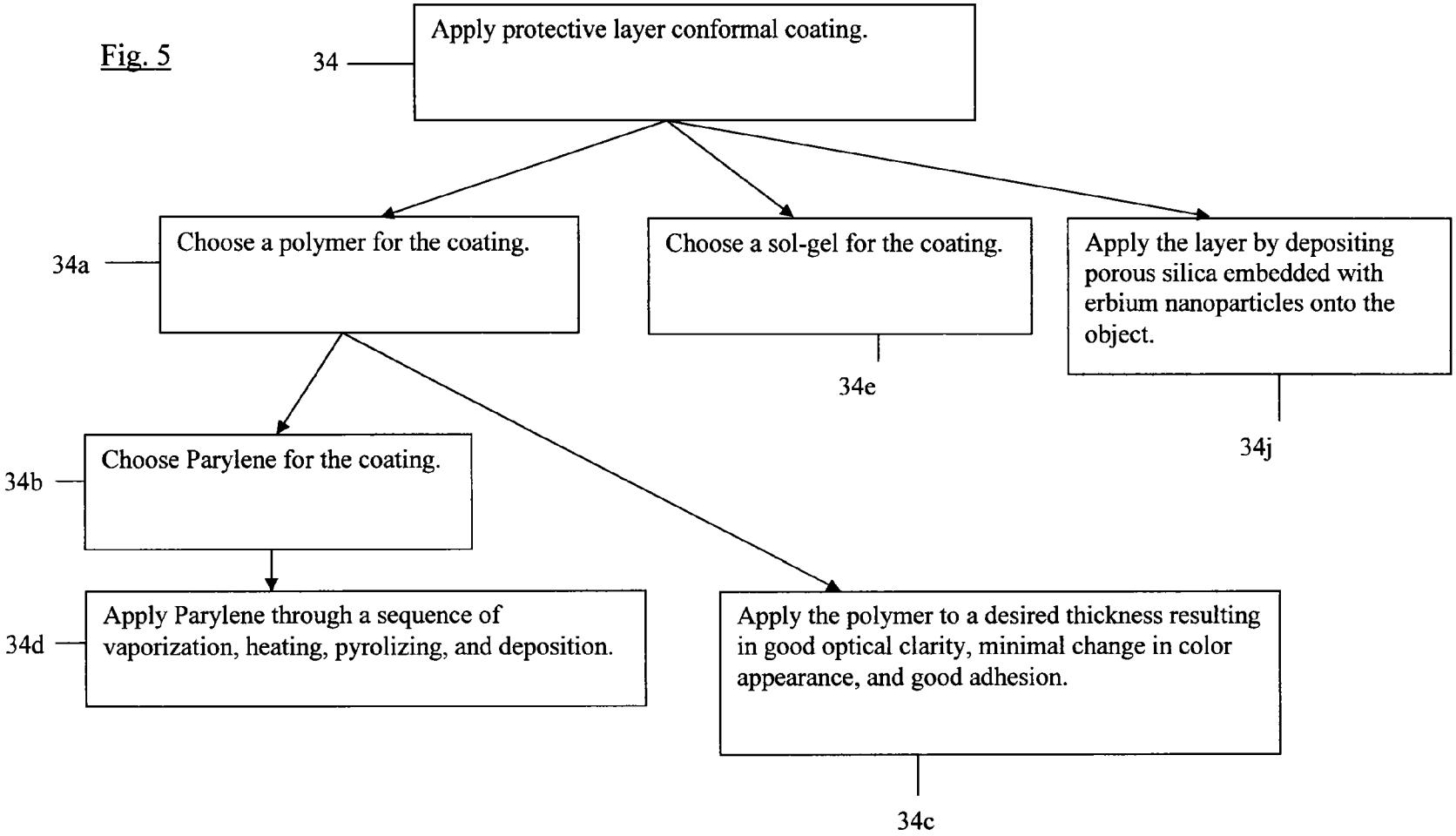
FIG. 5 is a flowchart further depicting an example method of applying treatment to an object including applying a protective layer conformal coating according to an embodiment of the invention.

Referring to FIGS. 2 and 5, after conformal multi-layer oxides treatment, the silver article or other metallic article is ready for the next step in the inventive anti-tarnish treatment, at 34, applying a protective layer conformal coating. A next step involves the conformal coating of the silver object with a protection layer that is organic in nature or that is inorganic in nature. The protective layer conformal coating provides a barrier to separate the multi-oxide layer from exposure to damage from mechanical wear and tear, chemicals, environment and moisture.

In one embodiment of the invention, referring to FIG. 5, at 34*a*, a polymer such as Parylene 34*b* is conformally coated over the multilayer oxide layer. The thickness of the polymer layer is chosen to maintain good optical clarity, minimal change in color appearance and good adhesion to the inorganic layer below it 34*c*. In one example embodiment, the range of thickness for Parylene conformal coating is between about 3-20 microns. Parylene or its variants demonstrates good thermal stability up to 290 C, excellent crevice penetration, and low coefficient of friction in addition to its excellent barrier properties. The process for deposition of Parylene is known and is typically done by vaporization of a dimer in vacuum followed by heating the dimerized gas and pyrolizing to cleave the dimer to monomeric form followed by deposition of the monomer at room temperature as a transparent polymer film 34*d*.

In another embodiment of the invention, the silver object with thin multilayer oxides applied is further protected by an inorganic sol gel coating or an organic-inorganic sol gel coating 34*e*. Sol-Gel processing designates a solid materials synthesis procedure, performed in a liquid and at low temperature (typically T<100 C). The physics and chemistry involved in sol-gel synthesis has been detailed in many reviewed papers as well as in books [10, 11]. The choice of the sol gel chemistry is dependent on the optical properties and annealing temperature of the resulting film. In one embodiment, a titanium dioxide solgel is coated conformally by a dip coating process using a tetraisopropyl-orthotitanate solution and ethanol as a solvent. Other example inorganic sol gel coatings include silica and alumina coatings. Hybrid coatings based on a combination of nanoparticles and solgel to create durable transparent protective film can also be used. One example of such a coating is the use of Boehmite nanoparticles in a silane dispersant.

An Example Anti-Tarnish Process for Thin Silver Films

The process below provides a step-by-step method for imparting tarnish resisting properties to thin films of silver that are deposited on various substrates to impart a functional or decorative property. In one embodiment of the invention, the process is applied for the manufacture of Kundan jewelry in two different ways.

Procedure 1:

As discussed above, Kundan jewelry manufacturing involves the use of silver foil that is cut into shapes and used as a reflective material placed behind the cut glass pieces or rough cut diamonds that are a key component of this jewelry style. The silver foil can be anti-tarnish treated using the procedure above which provides the foil with a conformal anti-tarnish property. The foil can be cut into the desired shapes during the Kundan jewelry manufacturing.

Procedure 2:

The cut glass pieces or rough cut diamond pieces are thoroughly cleaned by using a combination of solvent cleaning steps in a sonication bath. For example, the solvents acetone and isopropyl alcohol may be used.

The cleaned pieces are placed on holders with the flat side exposed. A thin film of pure silver is deposited on the exposed surface using a vapor coating process such as magnetron sputter deposition, evaporation or ion-assisted deposition (IAD). The silver coated pieces are thereafter treated as discussed above in which the nanoparticle dispersion is optional.

In another embodiment of the invention, the deposition of the highly reflective silver layer can be in combination with a high index film such as titanium oxide using multilayer deposition chemistry in the vapor coating process. The multilayer coating chemistry composed of a first layer of silver and a second layer of a high index oxide film results in the formation of a colored reflective surface and has application in the development of colored Kundan cut glass. The resulting colored Kundan cut glass has anti-tarnishing properties by virtue of the second coating layer deposited over the highly reflective silver layer.

An Example Process for Achieving a Gold Appearance

Figure 6:
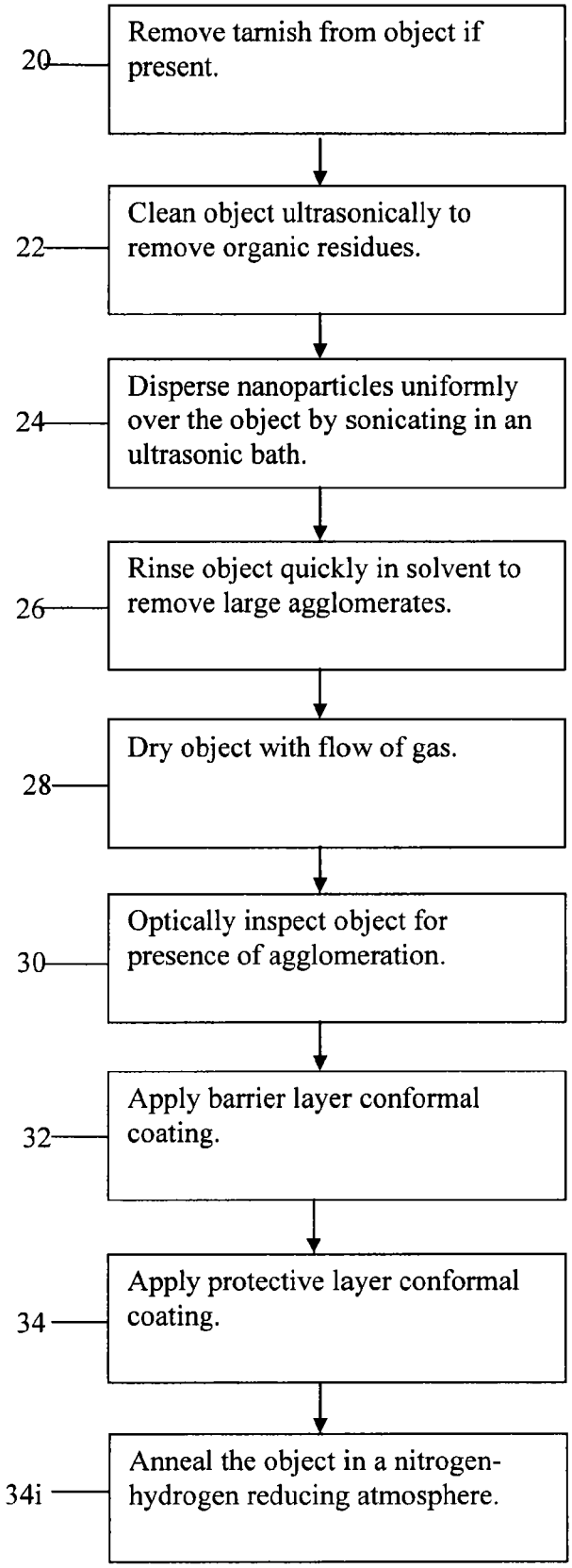
FIG. 6 is a flowchart depicting an example method of applying gold appearance to an object according to an embodiment of the invention.
Figure 7:
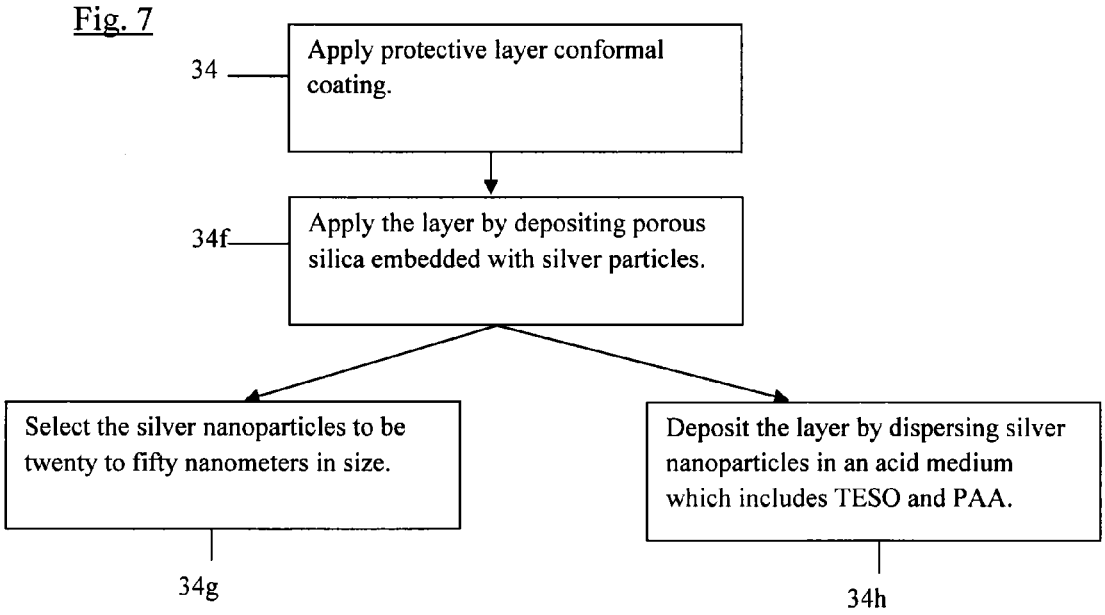
FIG. 7 is a flowchart further depicting an example method of applying treatment to an object including applying a protective layer conformal coating according to an embodiment of the invention of FIG. 6.

Referring to FIG. 6, in another embodiment, the thin films of multilayer compounds that are deposited on the surfaces of the nanoparticle dispersed silver object are tailored to produce a specific appearance such as gold, rose gold, colored gold, rhodium or other fancy colors. The thickness and composition of the thin film treatment are varied to achieve the exact color appearance desired.

The invention includes a combination process where the gold color is achieved. First, a thin film multilayer stack of oxides/nitrides/oxynitrides is applied 32*b*. This layer is the first barrier to tarnishing of silver. Second, an organic/inorganic complex of sol gel with compounds that will provide the final color appearance of gold is applied 34. The thickness of the first multilayer stack of oxide/nitride/oxynitrides allows some color development as compared to the treatment disclosed herein where silver is anti-tarnish clear treated. The second protection step 34 using sol gel or Parylene is also modified to allow color development.

If the substrate is silver or a silver alloy, cleaning and tarnish removal is performed as discussed above 20.

The article is then prepared by a thorough solvent based ultrasonic cleaning process to ensure that the surface is free of organic residues or contamination 22.

The disclosed treatment can also be applied to non-silver based objects, in which case the step of removing existing tarnish may not be required. An example is the transformation of brass articles or jewelry to the appearance of fine carat gold using the process described here. Another example of changing the appearance of a decorative object is to use the process described here on gold or gold plated jewelry to produce a look of antique gold.

In another embodiment, the surface of a metallic article such as delicate filigree gold jewelry is subjected to the above described process involving nano-particle dispersion. The nano particles may include nano-diamond or corundum nano-particles and may be followed by a thin film treatment composed of oxide or nitrides or oxynitrides of metals or alloys including but not limited to titanium or titanium-aluminum materials.

According to an example embodiment, a combination process is employed. The gold color is achieved through modification of the above described anti-tarnish process. First the thin film multilayer stack of oxides/nitrides/oxynitrides is made thicker. Second, the organic/inorganic complex of sol gel is modified with compounds that provide the final color appearance of gold. The thickness of the first multilayer stack of oxide/nitride/oxynitrides is such as to allow some color development as opposed to the above described silver anti-tarnish clear treatment. The second protection step using sol gel or Parylene is also modified to allow color development.

Generally, to achieve the gold appearance, the multilayer stack includes but is not limited to aluminum oxide, aluminum oxide/titanium dioxide stack, aluminum oxide/silica stack, aluminum oxide/silicon nitride or oxynitride stack.

After conformal multi-layer oxides treatment, the article is ready for the next step in creating a gold appearance. The next step involves the conformal coating of the substrate object with a protection layer. In one embodiment of the invention silver nanoparticles in porous silica are added to the sol gel to contribute to the appearance of gold.

In one embodiment of the invention, a polymer such as Parylene is conformally coated over the multilayer oxide layer to a range of thickness between about 3-20 microns.

In another embodiment of the invention, the object that has been conformally coated with thin multilayer oxides is further protected by an inorganic sol gel coating or an organic-inorganic sol gel coating as discussed above.

Specific Example of Method for Achieving Gold Appearance

All pre-existing tarnish is removed from a silver substrate by procedures discussed above 20.

The silver article is prepared by solvent based ultrasonic cleaning process to ensure that the surface is free of organic residues or contamination 22.

Nanoparticles are dispersed onto the surface of the silver article as discussed above. The nanoparticles are selected from nano-silver particles, nano-diamond particles, nano-platinum particles, silica nano-particles and corundum nano-particles. The nano-particles are dispersed uniformly over the silver article 24.

According to the method, nano-particles are typically dispersed in a solvent or water medium and a monolayer of the nano-particles can be dispersed over the silver article by immersion of the silver article into the slurry containing the nano-particles under the influence of an ultrasonic bath.

Sonication is performed in a regular sonic bath for a duration that can be optimized by experimentation based upon the substrate's geometry and size. The duration of the sonication is derived experimentally by performing the sonication of the silver article to be coated with a dispersion of nano-particles for various durations and examining the resulting for uniformity and density of coverage using an analytical technique such as scanning electron microscopy.

The article is removed from the slurry and quickly rinsed with a solvent to prevent the formation of large agglomerates 26.

The silver article is dried with nitrogen 28 and optical inspection is performed to check for agglomeration that shows up as dark residues 30.

Next, a layer of aluminum oxide is deposited 32 using IAD (ion assisted deposition) or ALD (atomic layer deposition) to thickness at least 70 nm.

Next, a layer of porous silica embedded with silver nano particles is deposited 34*f*. This layer is deposited with silver nano particles in the size range 20-50 nm 34*g* using sol-gel synthesis. In this example 34*h* tetraethylorthosilicate (TESO) and Polyacrylic acid (PAA) in acid media are used as synthesis materials in which are dispersed the silver nano-particles.

Last, the silver article is annealed in an N2-H2 reducing atmosphere at 450 C 34*i*.

It is expected that the creation of other colors can be achieved by using other types of nano particles in the silica sol gel layer. For example, it is expected that the appearance of pink gold can be created using Erbium nano particles 34*j*.

The invention also includes an object including the layers created by the various treatments disclosed in this application.

The invention may be embodied in other specific forms without departing from the spirit of the essential attributes thereof, therefore, the illustrated embodiments should be considered in all respects as illustrative and not restrictive, reference being made to the appended claims rather than to the forgoing description to indicate the scope of the invention.

REFERENCES

1. L. Gal-Or, 4th Santa Fe Symposium on Jewelry Manufacturing Technology (1990), p. 19.
2. H. Royal, 4th Santa Fe Symposium on Jewelry Manufacturing Technology (1990). P. 37.
3. R. M. Enick, U.S. Pat. No. 6,183,815 (2001).
4. T. D. Burleigh, Corrosion, V. 56 (2002), p. 49.
4. E. W. Salmon, 12th Santa Fe Symposium on Jewelry Manufacturing Technology (1998), p. 363.
6. Ullman's Encyclopedia of Industrial Chemistry, V. A24 (1993), p. 148.
7. [1]: CAL-IN Technology Transfer, LLC
8. Protective coating of Silver, Makela, Milja et al., US Patent Appl. 20090004386
9. Brinker, C. J.; Scherer, G. W. Sol-Gel Science. The Physics and Chemistry of Sol-Gel Processing, Academic Press, New York, 1990.
10. Pierre, A. C. Introduction to Sol-Gel Processing, Kluwer, Boston, 1998.

The invention claimed is:

1. An object, comprising:

a substrate;

a uniformly dispersed layer of selected nanoparticles directly covering a surface of the substrate;

a barrier layer conformal coating overlying the dispersed layer of selected nanoparticles selected from a group consisting of carbides, metals, metal alloys, metal compounds, combinations of organic/inorganic complex compounds and stacks thereof; and a protective layer conformal coating, comprising a polymer layer having a thickness of 3 to 20 microns;

wherein the polymer layer comprises parylene.

2. The object claimed in claim 1, wherein the selected nanoparticles include nanoparticles selected from a group consisting of silver nanoparticles, diamond nanoparticles, platinum nanoparticles, silica nanoparticles, and corundum nanoparticles.

3. The object claimed in claim 1, wherein the barrier layer conformal coating is further selected from a group consisting of oxides, oxynitrides and nitrides.

4. The object claimed in claim 1, wherein the thickness is chosen to maintain optical clarity, minimal change in color appearance and adhesion to the underlying barrier layer conformal coating.

5. The object claimed in claim 1, wherein the substrate comprises silver and the uniformly dispersed layer of selected nanoparticles, the barrier layer conformal coating and the protective layer conformal coating inhibit tarnishing of the silver.

6. The object claimed in claim 1, wherein the substrate comprises silver and the uniformly dispersed layer of selected nanoparticles, the barrier layer conformal coating and the protective layer conformal coating present a gold appearance.

7. The object claimed in claim 1, wherein the substrate is selected from a group consisting of silver, silver alloys, silver films, silver products, copper, copper alloys and brass.

8. The object claimed in claim 1, wherein the substrate comprises an article of jewelry.

9. The object claimed in claim 1, wherein the substrate comprises a nonprecious metal.

10. An object, comprising:

a substrate;

a uniformly dispersed layer of selected nanoparticles covering a surface of the object;

a barrier layer conformal coating overlying the dispersed layer of selected nanoparticles selected from a group consisting of carbides, metals, metal alloys, metal compounds, combinations of organic/inorganic complex compounds and stacks thereof; and a protective layer conformal coating;

wherein the protective layer conformal coating is selected to be the layer of porous silica and where in the layer of porous silica is embedded with erbium nanoparticles.

11. An object, comprising:

a substrate, selected from a group consisting of silver, silver alloys, silver films, silver products and nonprecious metals;

a uniformly dispersed layer of selected nanoparticles comprising diamond nanoparticles covering a surface of the substrate;

a barrier layer conformal coating overlying the dispersed layer of selected nanoparticles selected from a group consisting of carbides, metals, metal alloys, metal compounds, combinations of organic/inorganic complex compounds and stacks thereof; and a protective layer conformal coating overlying the barrier layer conformal coating, wherein the protective layer conformal coating is selected to be a sol-gel layer and wherein the sol-gel layer comprises Boehmite nanoparticles in a silane dispersant.

* * * * *